US005473796A

United States Patent [19]

Fusillo

[11] Patent Number: 5,473,796

[45] Date of Patent: Dec. 12, 1995

[54] SPIN-CLIP BAG CLOSURE

[76] Inventor: Joseph Fusillo, 25 Maple Rd., Cornwall on Hudson, N.Y. 12520

[21] Appl. No.: 204,787

[22] Filed: Mar. 2, 1994

[51] Int. Cl.[6] ..... A44B 21/00; B65D 77/00

[52] U.S. Cl. ..... 24/30.5 R; 24/338; 24/545; 24/557

[58] Field of Search ..... 24/543, 30.5 R, 24/30.5 S, 557, 562, 489, 339, 338, 337, 545, 542, DIG. 28, 67.9

[56] References Cited

U.S. PATENT DOCUMENTS

| | | | |
|---|---|---|---|
| 82,624 | 9/1868 | Matthews | 24/545 |
| 1,319,997 | 10/1919 | Galloway et al. | 24/545 |
| 2,099,177 | 11/1937 | Smith | 24/338 |
| 2,871,538 | 2/1959 | Richardson . | |
| 3,043,902 | 7/1962 | Klein | 24/339 |
| 3,324,518 | 6/1967 | Louderback | 24/557 |
| 3,609,638 | 9/1971 | Dar | 24/339 |
| 3,733,656 | 5/1973 | Stalder | 24/557 |
| 3,923,213 | 12/1975 | George et al. | 24/562 |
| 4,149,299 | 4/1979 | Welsh . | |
| 4,389,755 | 6/1983 | Villa-Real | 24/67.9 |
| 5,056,198 | 10/1991 | Viglione | 24/338 |
| 5,121,526 | 6/1992 | Burkard et al. | 24/337 |

FOREIGN PATENT DOCUMENTS

| | | | |
|---|---|---|---|
| 1599947 | 10/1981 | United Kingdom | 24/557 |

*Primary Examiner*—Victor N. Sakran
*Attorney, Agent, or Firm*—David Everett Meeks

[57] ABSTRACT

A bag closure device for sealing the end of a rolled, plastic produce bag of the type having two or more opposing jaws connected by struts and a flexible hinge for each set of opposed jaws. The hinge is made of flexible material. Teeth are placed on the inside surfaces of the opposing jaws to hold the rolled bag within the jaws. The device seals the bag by gripping the bag with each opposed jaw.

13 Claims, 7 Drawing Sheets

SPIN-CLIP BAG CLOSURE

BACKGROUND-FIELD OF THE INVENTION

This invention relates to plastic bag closures, specifically to such closures which are used for closing the necks of plastic produce bags.

BACKGROUND-DESCRIPTION OF PRIOR ART

Grocery stores and supermarkets commonly supply consumers with polyethylene bags for holding produce. Such bags are also used by suppliers to provide resealable containers for other items, both edible and inedible.

Originally these bags were sealed by the supplier with staples or by heat. However, consumers objected since these were of a rather permanent nature: the bags could only be opened by tearing, thereby damaging them and rendering them impossible to reseal.

Thereafter, inventors created several types of closures to seal plastic bags in such a way as to leave them undamaged after they were opened. U.S. Pat. No. 4,149,299 to Welsh (1979) discloses a complex clamp for closing a bag which can close the necks of bags without causing damage upon opening; however, these clamps are complex and difficult to use and manipulate by consumers. Thus, if a bag requires closure, this closure is useless to those who can not manipulate its parts to cause closure of the bag.

Although twist closures with a wire core are easy to use and inexpensive to manufacture, do not damage the bag upon being removed, and can be used repeatedly, nevertheless they simply do not possess the neat and uniform appearance of a clip closure, they become tattered and unsightly after repeated use, and they are difficult to remove and/or replace by many consumers who have difficulty manipulating the closure ends. They also do not offer suitable surfaces for the reception of print or labeling.

Several types of thin, flat closures have been proposed. Although inexpensive to manufacture, such closures can only be used once if they are made of frangible plastic since they must be bent or twisted when being removed and consequently will fracture upon removal. Thus, to reseal a bag originally sealed with a frangible closure, one must close its neck with another closure or else close the bag in makeshift fashion by folding or tying it.

All of the plastic closures heretofore known suffer from a number of disadvantages:

(a) The device does not stand up to repeated use, and either breaks and/or becomes unsightly, and must be replaced by the consumer to maintain freshness of the product.

(b) The device is difficult to manipulate and use by the consumer, and is therefore discarded and ignored after removal, resulting in less than satisfactory reclosure of the bag. Or the closure device is used repeatedly by the consumer, causing significant frustration and/or general dissatisfaction with the closure device and the product contained within the plastic bag.

OBJECTS AND ADVANTAGES

Accordingly, several objects and advantages of the present invention are:

(a) to provide a closure that is easy and convenient to use by all consumers without diifficulty or frustration;

(b) to provide a closure that can be used extremely rapidly without the manipulation of complex parts;

(c) to provide a closure that affords an air-tight seal of the product contained within the bag;

(d) to provide a closure that is long lasting and can be used repeatedly without wear or degradation of the device;

(e) to provide a closure that can be manufactured inexpensively of monolithic construction, without adjustable parts or parts requiring manipulation by the consumer;

(f) to provide a closure that can be used easily and conveniently by the elderly without causing undue frustration;

(g) to provide a closure that can be easily and conveniently used by consumers with vision impairment or blindness;

(h) to provide a closure with significant, planer surface area for the placement of advertising and labeling information;

(i) to provide a closure that can be manufactured in bright colors, for improved display of the merchandise;

(j) to provide a closure that can be manufactured in numerous colors, where each color can indicate the product or merchandise contained within the bag;

(k) to provide a closure that can be used repeatedly by the consumer, over a long period of time; and (l) to provide a closure that assures a complete seal of the produce bag, maintaining the optimum freshness of the product contained within.

DRAWING FIGURES

REFERENCE NUMERALS IN DRAWINGS

| | |
|---|---|
| 10 spin-clip closure device | 40 jaw hinge |
| 12 upper jaw member | 42 central hub |
| 14 lower jaw member | 44 plate shaped portion |
| 16 jaw | 46 upper edge portion |
| 28 central body | 48 lower edge portion |
| 30 upper connecting strut | 50 V-shaped radial notch |
| 32 lower connecting strut | 52 peripheral opening |
| 34 throat opening | 54 inside end |
| 36 mouth portion | 56 outward turned portion |
| 38 gripper teeth | 58 inside edge |

DESCRIPTION-FIGS. 1–2

Figure 1:
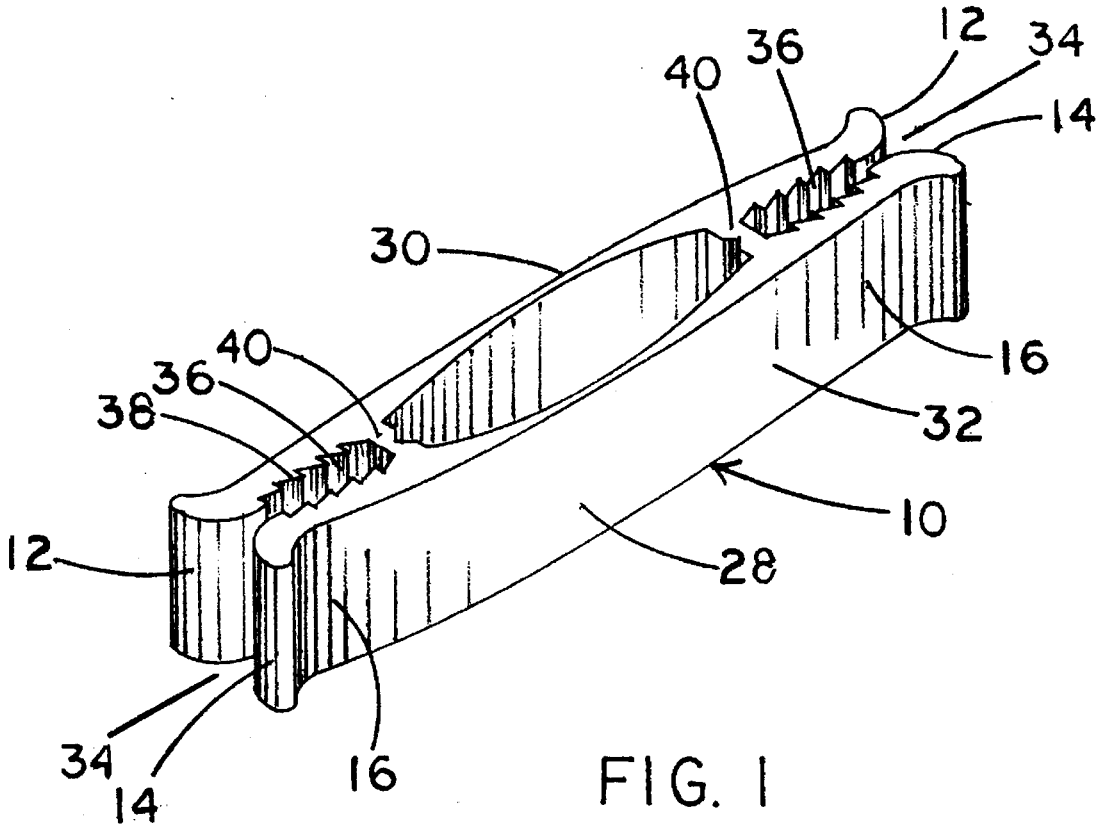
FIG. 1 shows a first embodiment of a spin-clip closure device.

A typical embodiment of a spin-clip bag closure of the present invention is illustrated in FIG. 1. The closure 10 has upper and lower opposing jaw members 12, 14 on one end and a second, similar upper and lower jaw members 12, 14 on the opposite end. These two ends are similar or identical, and are displaced an appropriate distance to grab hold of a plastic bag (not shown) at two places along its length at its open end. The upper and lower jaws members 12, 14 at each end form a throat opening 34 on each end, and a mouth portion 36 inside the throat opening on each end. The throat openings 34 are formed from the outer most portion of the upper and lower jaw members 12, 14. At their outer most portion, the upper and lower jaw members form the throat area by curving away from each other, creating a throat opening with beveled sides. At the inside of the throat, the jaw members curve outwardly from each other, forming an enlarged mouth portion 36. The mouth portion is of suitable size to engage the plastic bag for which it is used. At the back of the mouth portions 36 there are jaw hinges 40 that attach the upper and lower jaw members together at their innermost point. The jaw hinges are flat connectors that run from each upper jaw member to its mating lower jaw member the appropriate distance to form the appropriate spacing between the upper and lower jaw members, On the inside of the jaws, inside the mouth area, gripper teeth 38, shown as crosswise ridges, are used to secure and hold the bag inside the mouth area. An elongated central body 28 connects one jaw 16 to the other in a fixed, spaced relationship, in such a fashion that the spacing is appropriate to engage the open end of a plastic bag at two places, The central body 28 is a continuation of the two upper jaw members 12 in a flat or slightly curved upper connecting strut 30 and a continuation of the lower jaw members 14 in a similar, opposed connecting strut 32. As can be seen, the set of upper jaw members 12 and the upper connecting strut 30 form one, continuous, contoured sheet-like portion, as do the lower jaw members 14 and the lower strut 32. The jaw hinges 40 connect the upper and lower jaw members 12, 14 and the upper and lower connecting struts 30, 32 at an appropriate distance from their ends, to form a throat opening and mouth portion.

OPERATIONS-FIG. 1–2

The manner of using the spin-clip closure device is by first twisting the open end of a plastic bag into a rolled, cylindrical shape. The rolled end portion of the bag is then pulled into one of the mouth portions of the spin-clip, by pulling a lengthwise section of the bag into and through the beveled throat opening. A second section of the rolled bag portion is then pulled into the second mouth portion of the spin-clip. As can be appreciated, the twisted bag is now engaged by the jaws 16 on the opposite ends of the closure device, at an appropriate distance apart.

The operation can be described as the four discrete steps of:

(a) first, twisting the end of a plastic bag into a rolled, cylindrical shape;

(b) pulling a lengthwise portion of the rolled end through a the jaws on one end of the closure device;

(c) rotating the closure device to locate the jaws on the opposite end next to the rolled bag a fixed distance from the first engaged portion; and (d) pulling a second portion of the rolled bag through the opposite set of jaws.

From the description above, a number of advantages of my spin-clip closure device become evident:

(a) the rolled bag is engaged by the spin-clip closure device at two, spaced locations, resulting in an airtight seal; and (b) the spin-clip can be attached without difficulty or the requirement of clumsy, manipulative steps, which often result in poor or unsatisfactory closure or no closure at all.

DESCRIPTION-FIG. 3

Figure 2:
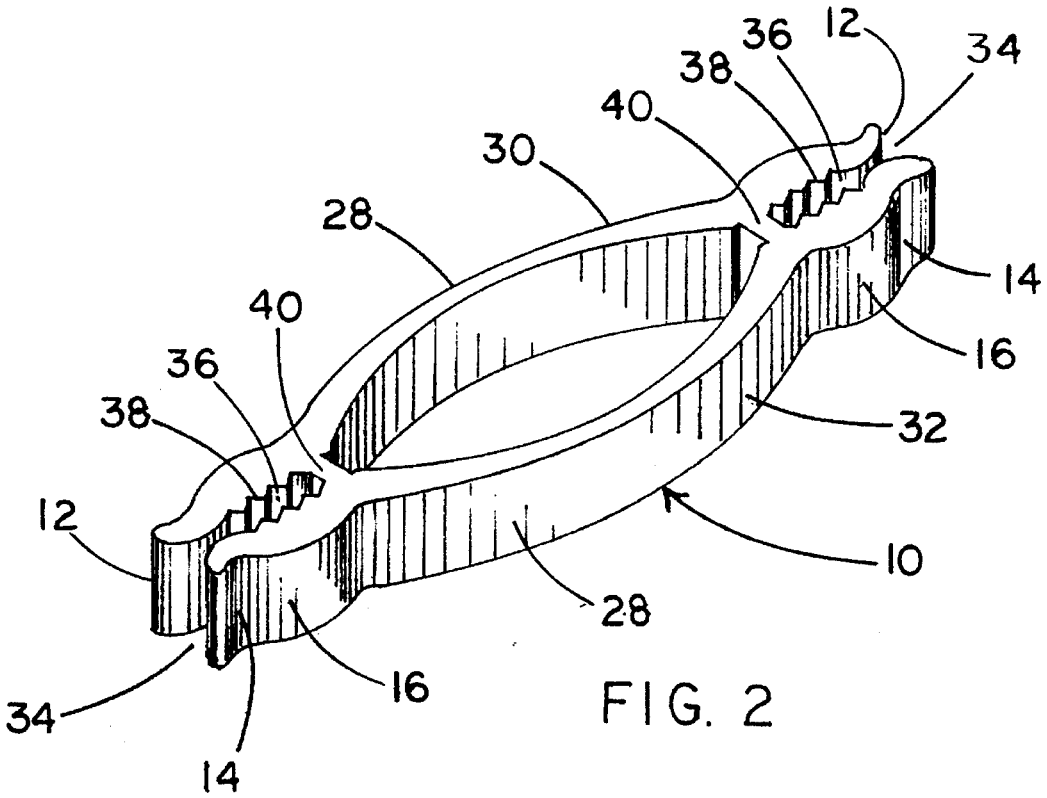
FIG. 2 shows a second embodiment of a spin-clip closure.
Figure 3:
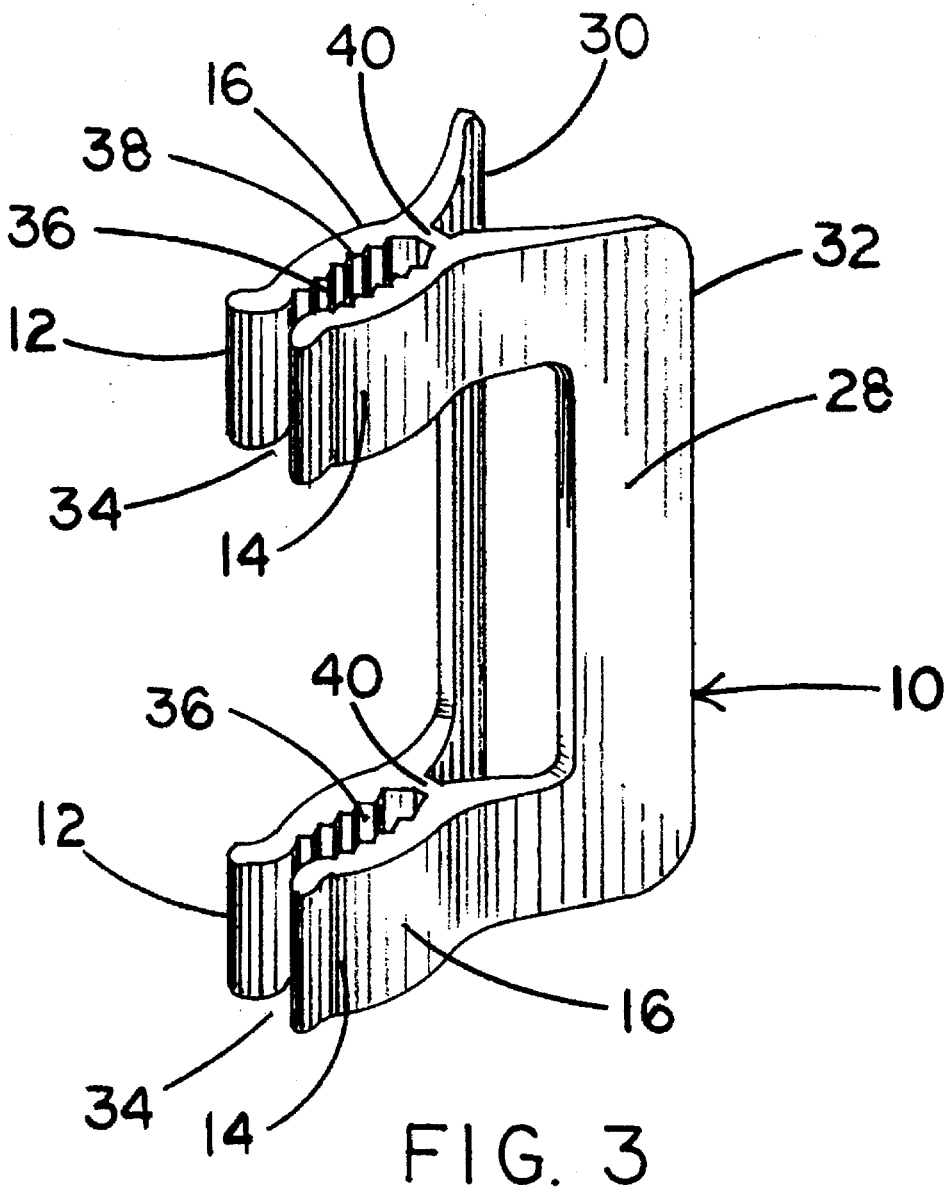
FIG. 3 shows a third embodiment of a spin-clip closure.

Another embodiment of the spin-clip closure device is shown in FIG. 3. The embodiment is different from FIG. 1–2 in that each end of the connecting struts 30, 32 have a right angled turn, so that each jaw 16 is turning in the same direction. The result is that the jaws 16 on each end of the device, instead of being opposed as in FIG. 1–2, are now parallel to each other, at a fixed, appropriate distance.

OPERATION-FIG. 3

The operation of the embodiment of the spin-clip closure device shown in FIG. 3 is similar to that in FIG. 1–2. The end of the bag is twisted into the familiar rolled shape. A lengthwise portion of the rolled bag is then pulled into a first jaw, and a second lengthwise portion of the bag is pulled into the other, second jaw. In this embodiment, the twisted bag end remains straight as it passes through the two jaws. The two struts 30, 32 of the central body 28 form a convenient handle for holding the closure during engagement of the bag. Alternately, the closure device can be placed onto a flat surface, such as a table or counter top, so that the struts 30, 32 are resting on the surface with the throat openings 34 facing upward. In this position, the twisted end of the plastic bag can be pulled or pushed into the jaws, either simultaneously or one at a time.

DESCRIPTION-FIG. 4–5

Figure 4:
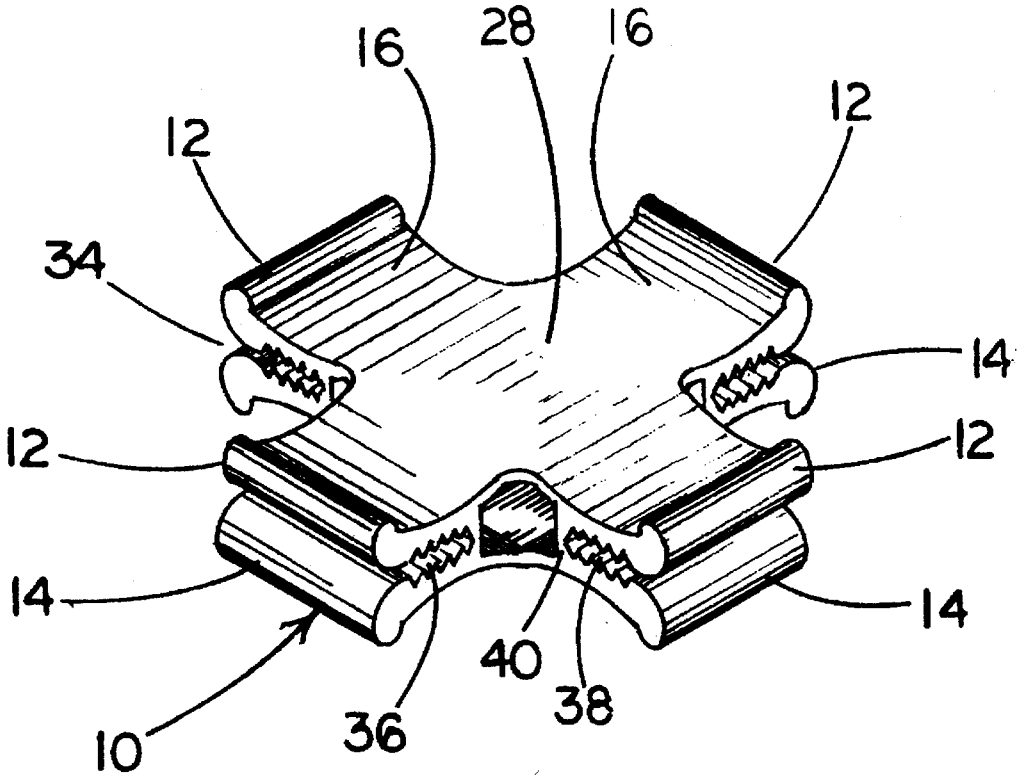
FIG. 4 shows a fourth embodiment of a spin-clip closure.

The spin-clip closure device of FIG. 4 has a solid central body 28. The body 28 extends outwardly from the center at each quadrant. Each outward projection is shaped to form upper and lower jaw members 12, 14. Each set of upper and lower jaw members 12, 14 form a throat opening 34, with a mouth portion 36 inside of each throat opening. The throat is formed from the outermost portion of each upper and lower jaw member 12, 14. The upper and lower jaw members 12, 14 curve away from each other, creating the throat opening 34. At the inside of the throat, the jaws curve outward, forming the mouth portion 36. The mouth is of suitable size to engage the plastic bag for which it is used. Gripper teeth 38 are placed inside the mouth portion 36 to secure and hold the bag in place. The gripper teeth are shown as cross wise ridges. The back portion of the mouth portion 36 is integral with the central body 28 on each jaw, and forms a connection for each upper jaw member 12 to each respective lower jaw member 14, at their rear. This connection forms the jaw hinge 40 at each of four places, one for each jaw.

Figure 5:
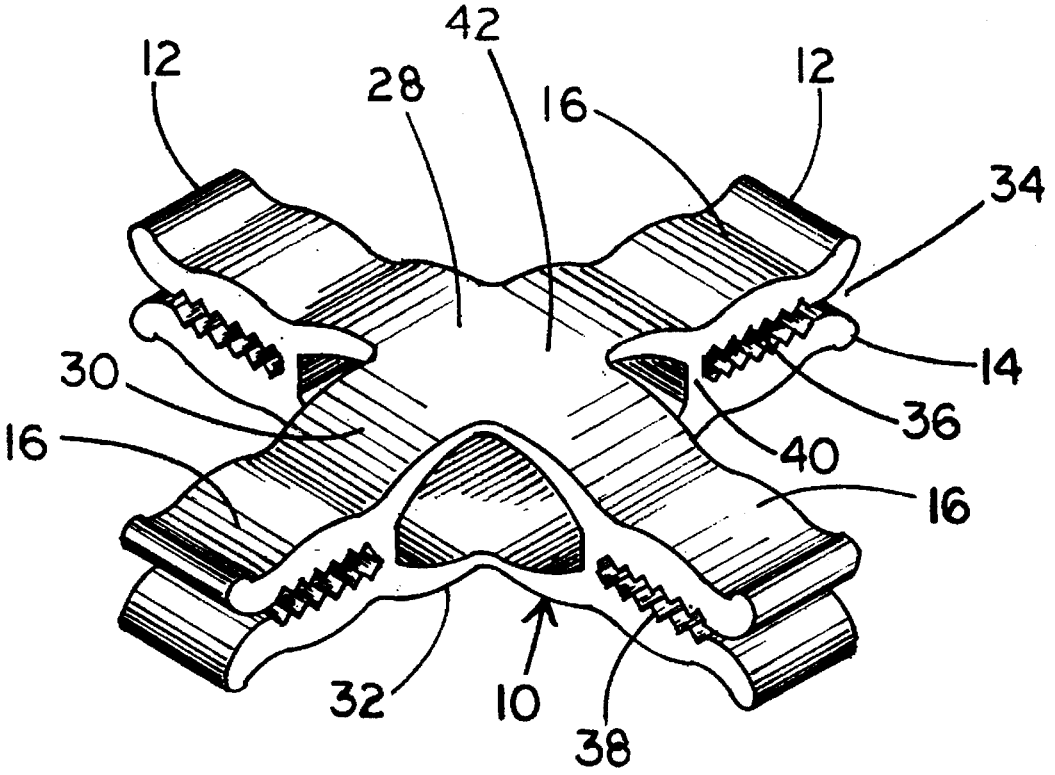
FIG. 5 shows a fifth embodiment of a spin-clip closure.

The spin-clip closure device 10 of FIG. 5 has a central body 28 that is formed from a continuation of four upper jaw members 12 and four lower: jaw members 14, forming flat or slightly curved upper and lower connecting struts 30, 32. The strut from each upper jaw member, spaced in each quadrant, meet at the center to form a central hub 42. The strut from each lower jaw member, spaced in each quadrant, meet in the center to form a second, central hub 42. At the back of the mouth portions 36 there are jaw hinges 40 that attach each mating set of upper and lower jaw members together.

OPERATION-FIG. 4–5

The manner of using the spin-clip closure device of FIG. 4–5 is similar to the operation in FIG. 1–2. The operation can be described as the same four step procedure described above, with the exception that in step (c) the device is rotated 90 degrees prior to engagement of the second portion of the rolled end of the bag. As can be appreciated, the twisted end of the bag can be pulled into and engaged by a first and second set of jaws in bordering quadrants, or it may be pulled into and engaged by three or even all four sets of jaws, in succession.

DESCRIPTION-FIG. 6

Figure 6:
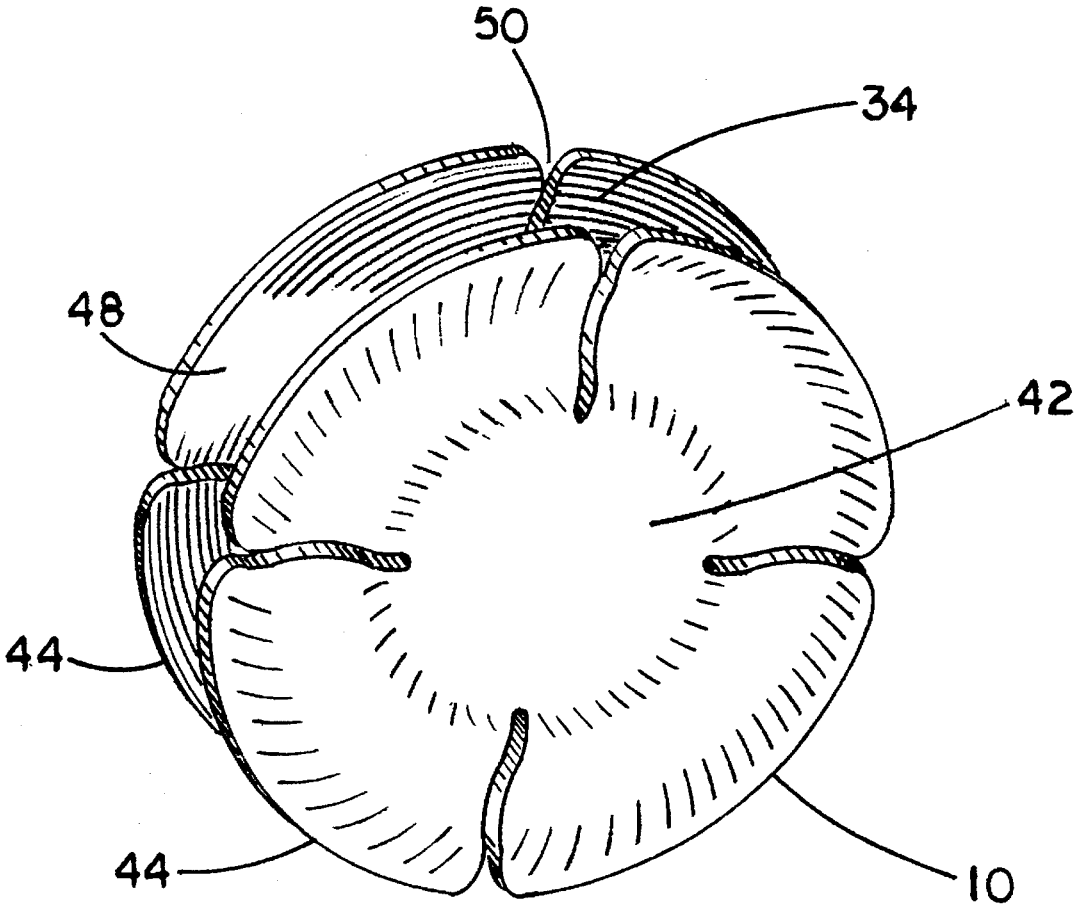
FIG. 6 shows a sixth embodiment of a spin-clip closure.

The spin-clip closure device 10 in FIG. 6 is formed by placing two circular, plate shaped portions 44 back-to-back to form a disc shaped structure with a central hub 42 and outwardly extending upper and lower edge portions 46, 48. The upper and lower edge portions, which curve away from each other, form a V or U-shaped peripheral opening 52 around the central hub 42. The peripheral opening 52 is shaped to engage and hold the twisted end of a plastic bag.

At one or more points on the upper and lower edge portions 46, 48 radial notches 50 are present. These openings give the edges 46, 48 additional flexibility to move away from each other when they are pulled apart during operation.

OPERATION-FIG. 6

The manner of using the spin-clip closure device in FIG. 6 requires that a lengthwise portion of the familiar rolled end of the plastic bag be pulled into a portion of the peripheral opening 52 in such a way that the upper and lower edge portions 46, 48 are forced away from each other, allowing the lengthwise portion of the bag to enter into the peripheral opening 52. The rolled bag remains inside the opening by the pressure of the upper and lower edge portions 46, 48. The lengthwise twisted end of the bag can engage a small or large portion of the peripheral opening, depending on the needs of the user.

DESCRIPTION-FIG. 7

Figure 7:
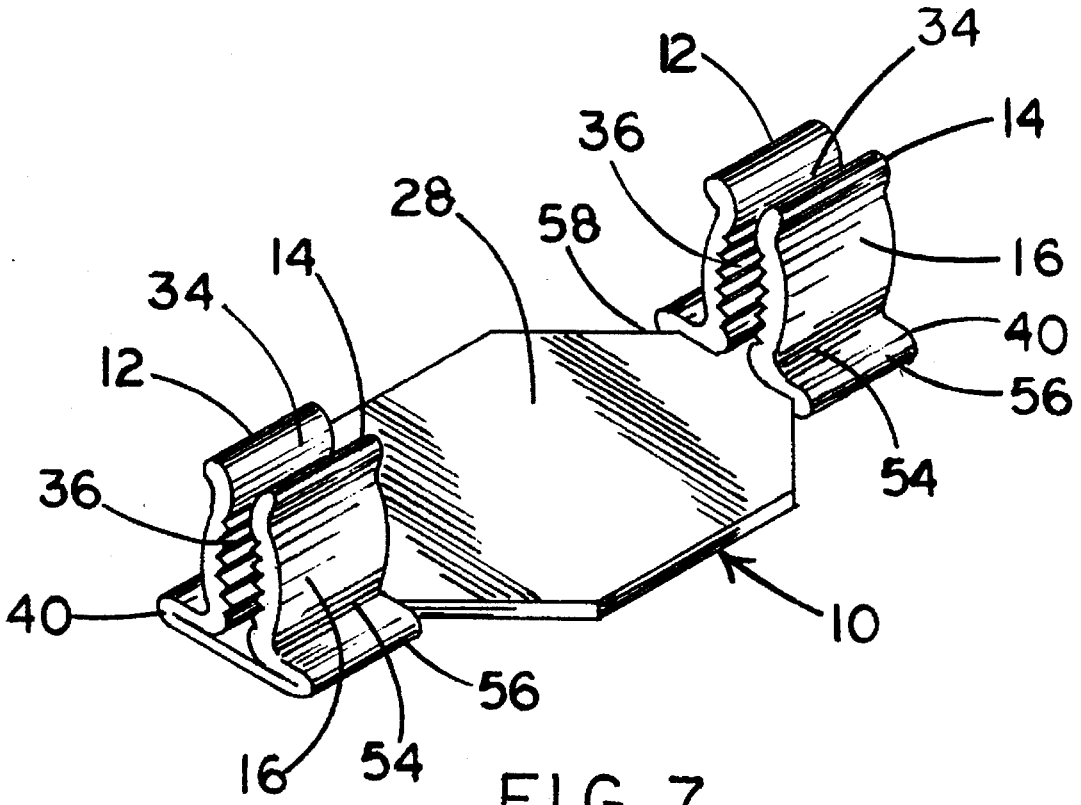
FIG. 7 shows a seventh embodiment of a spin-clip closure.

The preferred embodiment of the spin-clip closure device is shown in FIG. 7. The closure has upper and lower jaw members 12, 14 on one end and a second set of similar upper and lower jaw members 12, 14 on the opposite end. The upper and lower jaw members 12, 14 on each end form a throat opening 34 on each end, and a mouth portion 36 inside the throat opening on each end. The throat openings 34 are formed from the outer most portion of the upper and lower jaw members 12, 14. The embodiment is different from FIG. 3 in that the jaw hinge 40 is constructed by turning the inside ends 54 of each jaw member outwards a short distance in the transverse direction, and then turning the outward turned portion 56 in the opposite direction to meet the opposing portion from the opposite jaw, forming a C-shaped jaw hinge 40. The two sets of jaws are attached together by a central body 28 that attaches to the inside edge 58 of each hinge 40. The central body 28 is a flat, plate shaped connecting piece whose outer edges on two sides meet the inside edge 58 of the hinges. The central body 28 is elongated so that the jaws 16 on each end are spaced to properly engage the twisted end of a plastic bag.

OPERATION-FIG. 7

The operation of the preferred embodiment of the spin-clip closure device in FIG. 7 is similar to that in FIG. 3. The device in FIG. 7 is particularly adapted to be rested on a flat surface, such as a table or counter top, during the time that the twisted bag is pulled into the two jaws. This is because the central body 28 is a large, flat surface giving the device great stability while resting on a flat surface, such as a table or counter top.

SUMMARY, RAMIFICATIONS, AND SCOPE

Accordingly, the reader will see that the spin-clip closure of this invention can be used to seal a plastic bag easily and conveniently, can be removed just as easily and conveniently and without damage to the bag, and can be used to reseal the bag without requiring a new closure. Furthermore, the closure has additional advantages in that (a) it provides a closure that can be easily used by all, including the infirm or vision impaired;

(b) it permits rapid closure of the bag in an air-tight seal;

(c) it provides a low cost, easy to manufacture device without moving parts or complex mechanisms requiring manipulative effort;

(d) it provides a closure device with significant, flat surface area for affixing product information;

(e) it allows the closure to be brightly colored for identification purposes;

(f) it provides a closure that can be reused repeatedly without deformation or deterioration of the device; and (g) it provides a positive, air-tight seal to prevent spoilage of the product contained within.

Although the description above contains many specifications, these should not be construed as limiting the scope of the invention but merely providing illustrations of some of the presently preferred embodiments of this invention. For example, the closure can have other shapes, such as trapezoidal, triangular, square, etc; the lead-in throat area can have other shapes, etc.

Thus the scope of the invention should be determined by the appended claims and their legal equivalents, rather than by the examples given.

I claim:

1. A bag closure device comprising (a) an elongated central body, (b) opposing jaws extending from opposite ends of said central body, (c) said opposing jaws comprising, (d) an upper jaw member, (e) a lower jaw member, (f) said upper and lower jaw members shaped to form a throat opening at their outermost portion, (g) said upper and lower jaw members shaped to form a mouth at their inside portion, (h) and a hinge at the innermost portion of each jaw set to hold each upper and lower jaw member in a fixed, spatial relationship, whereby, a rolled plastic produce bag end is pulled into each jaw to form an airtight bag closure.

2. The bag closure device of claim 1 having two sets of opposing jaws wherein said central body comprises an upper connecting strut and a lower connecting strut, said upper strut being a substantially flat connecting part that is a continuation of the two upper jaw members at each end of said upper strut, and said lower strut being a substantially flat connecting part that is a continuation of the two lower members at each end of said lower strut.

3. The bag closure device of claim 1, further including gripper teeth on the upper and lower jaw members to grip and hold the plastic bag in the mouth.

4. The closure device of claim 1 wherein said jaw hinge is a flat, flexible plate that runs from the upper jaw member to the lower jaw member, said jaw hinge formed from flexible material to allow the jaws to move relative to each other by the action of the hinge.

5. The closure device of claim 1, wherein said upper and lower jaw members are similarly shaped opposed curved plates, said curvature forming a beveled throat opening on the outermost portion, and an enlarged mouth area on the inside.

6. The bag closure device of claim 1, wherein said opposing jaws extend laterally from the opposite ends of said central body.

7. The bag closure device of claim 1, wherein said opposing jaws extend longitudinally from the opposite ends of said central body.

8. A bag closure device for holding and sealing the rolled end of a plastic bag comprising;

four jaws, each jaw comprising an upper and lower jaw member, a strut member associated with and extending inwardly from each upper and lower jaw member, wherein each jaw is fixed in a quadrant of the device forming a circular arrangement with each jaw extending outwardly, wherein each strut member is directed inwardly towards the center, and a central hub member attached to the four struts from the upper jaw members and a second central hub member attached to the four struts from the lower jaw members, said central hubs connecting each set of struts together, and a hinge connecting each upper jaw member to its opposing lower jaw member.

9. The bag closure of claim 8, wherein the device is molded from plastic, wherein the four upper jaw members at each quadrant and a strut member associated with each jaw extend inwardly and attach to a central hub, said jaws, struts, and central hub form a first portion, and wherein the four lower jaw members at each quadrant and a strut member associated with each lower jaw member extend inwardly and attach to another central hub, said jaws, struts, and central hub form a second portion disposed parallel to the first portion such that matching upper and lower jaws match up with each other, and a hinge located between the jaws and struts at each quadrant connecting the two portions together.

10. The bag closure of claim 8, further comprising;

gripping teeth placed within each set of opposing jaws for gripping a rolled plastic bag, and the composition of the plastic material from which the part is made colored for identification purposes.

11. The bag closure of claim 8, wherein each jaw comprises;

an upper and lower jaw member opposing each other, said upper and lower jaw members similarly shaped to form an outer throat opening to direct a bag inwardly, and a mouth portion inwards of said throat opening, to hold a portion of a rolled plastic bag, and gripper teeth placed on each jaw, to prevent the rolled bag from sliding out.

12. A bag closure device comprising a first jaw and a second jaw spaced apart, a central body connecting said first jaw and said second jaw, wherein said first jaw and said second jaw are substantially parallel facing upwards from said central body, wherein said first and said second jaws each comprise an opposing upper jaw member and lower jaw member, wherein each respective upper and lower jaw member defines a throat opening and a mouth portion, and a jaw hinge connecting each upper jaw member to its opposing lower jaw member, wherein each jaw hinge comprises an outward turned portion from the bottom of said upper jaw, a second outward turned portion from said lower jaw member, wherein said outward turned portions turn back towards the center to meet the outward turned portion from the opposing jaw member, thereby forming a C-shaped hinge connecting the upper jaw member to said lower jaw member.

13. The bag closure device of claim 12 wherein the central body is a planer surface adapted to rest on a flat surface.

* * * * *